US010665968B2

(12) United States Patent
Otaka et al.

(10) Patent No.: US 10,665,968 B2
(45) Date of Patent: May 26, 2020

(54) TERMINAL BLOCK

(71) Applicant: OMRON Corporation, Kyoto-shi, Kyoto (JP)

(72) Inventors: Keisuke Otaka, Yokohama (JP); Sadahito Otsu, Kyoto (JP); Naoki Ueno, Kyoto (JP); Osamu Yoshitake, Kyoto (JP); Takahito Mizue, Kyoto (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 16/329,245

(22) PCT Filed: Sep. 26, 2017

(86) PCT No.: PCT/JP2017/034709
§ 371 (c)(1),
(2) Date: Feb. 28, 2019

(87) PCT Pub. No.: WO2018/062163
PCT Pub. Date: Apr. 5, 2018

(65) Prior Publication Data

US 2019/0252807 A1 Aug. 15, 2019

(30) Foreign Application Priority Data

Sep. 30, 2016 (JP) ..... 2016-194249

(51) Int. Cl.
*H01R 9/24* (2006.01)
*H01R 4/48* (2006.01)

(52) U.S. Cl.
CPC ..... *H01R 9/24* (2013.01); *H01R 4/48* (2013.01)

(58) Field of Classification Search
CPC ..... H01R 4/4818; H01R 4/4827; H01R 4/28; H01R 9/24

(Continued)

(56) References Cited

U.S. PATENT DOCUMENTS 4,566,748 A 1/1986 Tanishi et al.
5,454,730 A * 10/1995 Tozuka ..... H01R 4/4818 439/438

(Continued)

FOREIGN PATENT DOCUMENTS

CN 1094858 A 11/1994
CN 1453902 A 11/2003

(Continued)

OTHER PUBLICATIONS

International Search Report ("ISR") of PCT/JP2017/034709 dated Nov. 28, 2017.

(Continued)

*Primary Examiner* — Gary F Paumen
(74) *Attorney, Agent, or Firm* — Metrolex IP Law Group, PLLC

(57) ABSTRACT

A terminal block includes a housing having an accommodation portion and a through hole, a terminal portion disposed in the accommodation portion, and a plate spring portion that is disposed in the accommodation portion and, together with the terminal portion, holds a wiring member inserted into the accommodation portion through the through hole. A first side wall portion and a second side wall portion are formed in the accommodation portion of the housing, the first side wall portion and the second side wall portion facing each other in a direction that intersects with a direction in which the plate spring portion and the terminal portion hold the wiring member. A movement, in the intersecting direction, of a portion of the wiring member that is inserted into the accommodation portion is curbed by disposing the portion of the wiring member that is inserted into the accommodation portion between the first side wall portion and the second side wall portion. It is possible to obtain a terminal block capable of inhibiting the wiring (Continued)

member held between the plate spring portion and the terminal portion from coming off.

1 Claim, 8 Drawing Sheets

(58) Field of Classification Search
USPC ..... 439/441
See application file for complete search history.

(56) References Cited

U.S. PATENT DOCUMENTS

| | | | | |
|---|---|---|---|---|
| 5,975,940 | A * | 11/1999 | Hartmann | H01R 4/4818 439/441 |
| 6,832,938 | B2 * | 12/2004 | Lenker | H01R 4/4836 439/441 |
| 7,281,942 | B2 * | 10/2007 | Swedberg | H01R 4/4836 439/441 |
| 7,722,384 | B2 * | 5/2010 | Breen, IV | H01R 4/22 439/441 |
| 7,753,718 | B2 * | 7/2010 | Bethurum | H01R 4/4818 439/293 |
| 7,785,134 | B2 * | 8/2010 | Dhandapani | H01R 4/4818 439/441 |
| 8,366,471 | B2 | 2/2013 | Giefers | |
| 8,944,843 | B2 * | 2/2015 | Keswani | H01R 4/4836 439/441 |
| 2003/0171041 | A1 | 9/2003 | Blaha | |
| 2004/0248457 | A1 * | 12/2004 | Walter | H01R 4/4836 439/441 |
| 2007/0099479 | A1 * | 5/2007 | Holterhoff | H01R 4/4836 439/441 |
| 2007/0099480 | A1 * | 5/2007 | Fabian | H01R 13/4367 439/441 |
| 2013/0237095 | A1 | 9/2013 | Keswani | |
| 2019/0252808 | A1 * | 8/2019 | Otaka | H01R 4/48 |

FOREIGN PATENT DOCUMENTS

| | | | |
|---|---|---|---|
| CN | 1639920 | A | 7/2005 |
| EP | 1357640 | A2 | 10/2003 |
| GB | 2251738 | A | 7/1992 |
| JP | S57-191966 | A | 11/1982 |
| JP | 2000-048875 | A | 2/2000 |
| JP | 2003-317822 | A | 11/2003 |
| JP | 4071174 | B2 | 4/2008 |
| JP | 2009-218141 | A | 9/2009 |

OTHER PUBLICATIONS

International Searching Authority ("ISA") Written Opinion ("WO") of PCT/JP2017/034709 dated Nov. 28, 2017.
International Preliminary Examining Authority ("IPEA") Written Opinion ("WO") of PCT/JP2017/034709 dated Mar. 6, 2018.
Extended European search report dated Oct. 28, 2019 in a counterpart European patent application.
The Office Action dated Dec. 20, 2019 in a related Chinese patent application.

* cited by examiner

TERMINAL BLOCK

TECHNICAL FIELD

The present invention relates to a terminal block capable of fixing a wiring member to a terminal portion using a plate spring.

RELATED ART

As disclosed in JP 2000-048875A (Patent Document 1), a wiring member such as a single wire or a rod terminal is fixed to a terminal portion of a terminal block. A structure for detachably fixing a wiring member to a terminal portion using a plate spring is known as a structure for fixing a wiring member to a terminal portion. Such a terminal block is used in various electronic devices such as a circuit breaker and a PLC (Programmable Logic Controller).

In the terminal block (electrical wire connection device) disclosed in Patent Document 1 above, the plate spring and the terminal portion are disposed to be opposite each other in a housing. The wiring member is inserted between the plate spring and the terminal portion, the wiring member is held between the plate spring and the terminal portion, and thus the wiring member is fixed. When the wiring member is detached therefrom, the wiring member can be pulled out by deforming the plate spring that presses the wiring member against the terminal portion in a direction away from the wiring member (terminal portion).

RELATED ART DOCUMENTS

Patent Documents

Patent Document 1: JP 2000-048875A

SUMMARY OF THE INVENTION

Problem to be Solved by the Invention

Let us assume that a wiring member is inserted between a plate spring and a terminal portion, and the wiring member is held therebetween. In this state, the plate spring and the terminal portion apply holding forces to the wiring member in directions in which they hold the wiring member, and thus the wiring member hardly moves in these directions (the directions in which the holding forces act).

However, with a conventional terminal block, the wiring member is hardly fixed in a direction that intersects with (for example, a direction that is orthogonal to) the directions in which the plate spring and the terminal portion hold the wiring member. Thus, for example, if a twisting force repeatedly acts on the wiring member, the wiring member repeatedly moves back and forth in the intersecting direction, and as a result, there is a possibility that the wiring member will come off from a position between the plate spring and the terminal portion.

An object of the present invention is to provide a terminal block including a structure that is capable of further reducing the possibility that a wiring member held between a plate spring portion and a terminal portion will come off from a position between the plate spring portion and the terminal portion, compared to a conventional structure.

Means for Solving the Problems

A terminal block based on the present invention includes a housing having a front portion, an accommodation portion located on an inner side when viewed from the front portion, and a through hole that extends from the front portion to the accommodation portion, a terminal portion disposed in the accommodation portion of the housing, and a plate spring portion that is disposed in the accommodation portion of the housing and, together with the terminal portion, holds a wiring member inserted into the accommodation portion through the through hole, in which a first side wall portion and a second side wall portion are formed in the accommodation portion of the housing, the first side wall portion and the second side wall portion facing each other in a direction that intersects with a direction in which the plate spring portion and the terminal portion hold the wiring member, and a movement, in the intersecting direction, of a portion of the wiring member that is inserted into the accommodation portion is curbed by disposing the portion of the wiring member that is inserted into the accommodation portion between the first side wall portion and the second side wall portion.

Preferably, in the terminal block, the plate spring portion includes a base portion that constitutes a fixed end of deflection deformation and a front end portion that constitutes a free-end of deflection deformation when the plate spring portion is pressed by the wiring member inserted into the accommodation portion through the through hole, and the first side wall portion and the second side wall portion are located opposite the through hole with respect to the front end portion of the plate spring portion in a state in which the wiring member is not inserted into the through hole.

Preferably, in the terminal block, if a direction in which the plate spring portion undergoes deflection deformation when the wiring member is inserted into the accommodation portion is regarded as a downward direction and a direction in which a restoring force of elastic deformation of the plate spring portion acts is regarded as an upward direction, the accommodation portion is provided with an inner wall portion that intersects with an axis of the through hole, the inner wall portion is provided with a U-shaped recessed groove in which a side in the upward direction is open and a side in the downward direction is closed, and the first side wall portion and the second side wall portion are formed in the recessed groove.

Effects of the Invention

According to the above-described configuration, a movement of a portion of a wiring member that is inserted into an accommodation portion is curbed by a first side wall portion and a second side wall portion that are formed in the accommodation portion, and thus it is possible to further reduce the possibility that the wiring member held between a plate spring portion and a terminal portion will come off from a position between the plate spring portion and the terminal portion, compared to a conventional configuration.

EMBODIMENTS OF THE INVENTION

Figure 1:
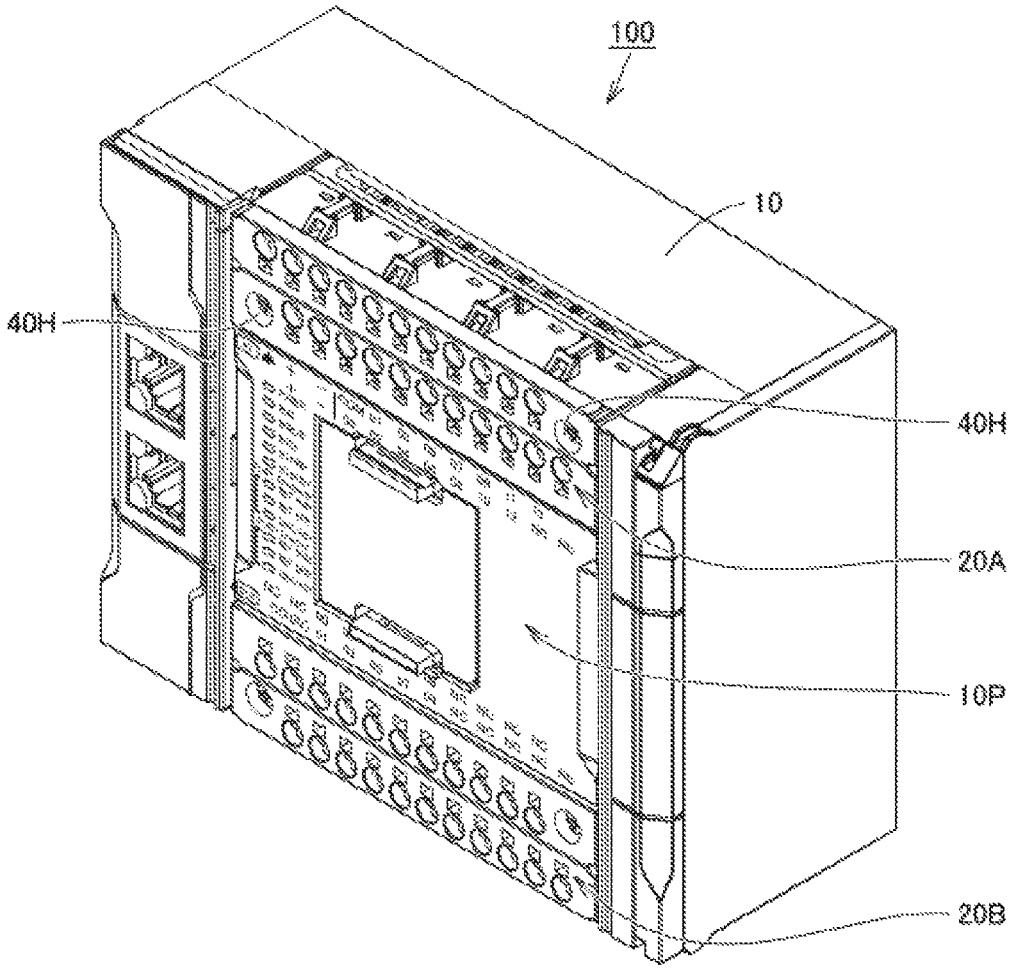
FIG. 1 is a perspective view showing a control device 100.

Hereinafter, an embodiment will be described with reference to the drawings. The same components and equivalent components are given the same reference numerals, and a redundant description is not repeated in some cases.

Embodiments

Control Device 100

FIG. 1 is a perspective view showing a control device 100. The control device 100 includes a display panel 10P and terminal blocks 20A and 20B on the front side of a main body unit 10, and can function as a PLC (programmable logic controller).

The terminal block 20A may be a means for ensuring electrical connection between the control device 100 and an external device such as a sensor, and a plurality of wiring members (not shown) for transmitting an input signal to the control device 100 are connected to the terminal block 20A. The terminal block 20B may be a means for ensuring electrical connection between the control device 100 and an external device such as a personal computer, and a plurality of wiring members (not shown) for transmitting an output signal are connected to the terminal block 20B.

Terminal Block 20A

The terminal blocks 20A and 20B have approximately the same configuration, and thus only the terminal block 20A will be described below and a description of the terminal block 20B is not repeated. Specifically, a configuration of the terminal block 20A in this embodiment will be described with reference to FIGS. 2 to 6. Effects of the tea urinal block 20A will be described later with reference to FIGS. 7 and 8.

Figure 2:
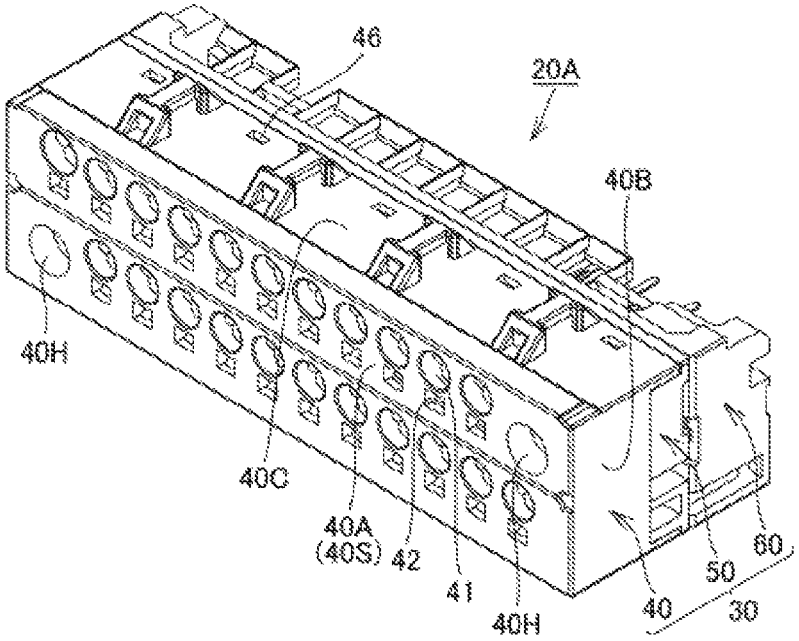
FIG. 2 is a perspective view showing a terminal block 20A.
Figure 3:
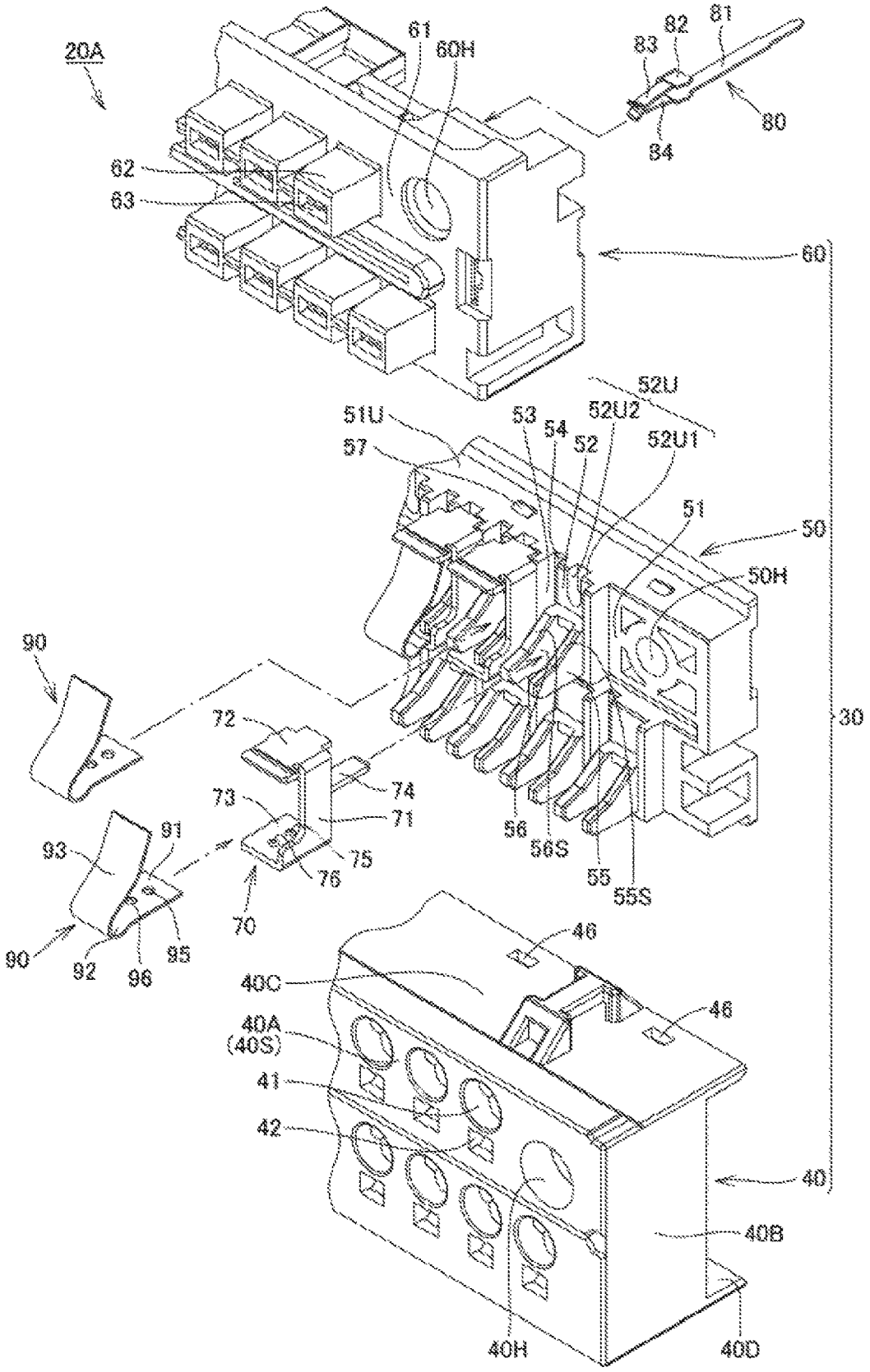
FIG. 3 is a first perspective view (cross-sectional perspective view) showing the exploded terminal block 20A.
Figure 4:
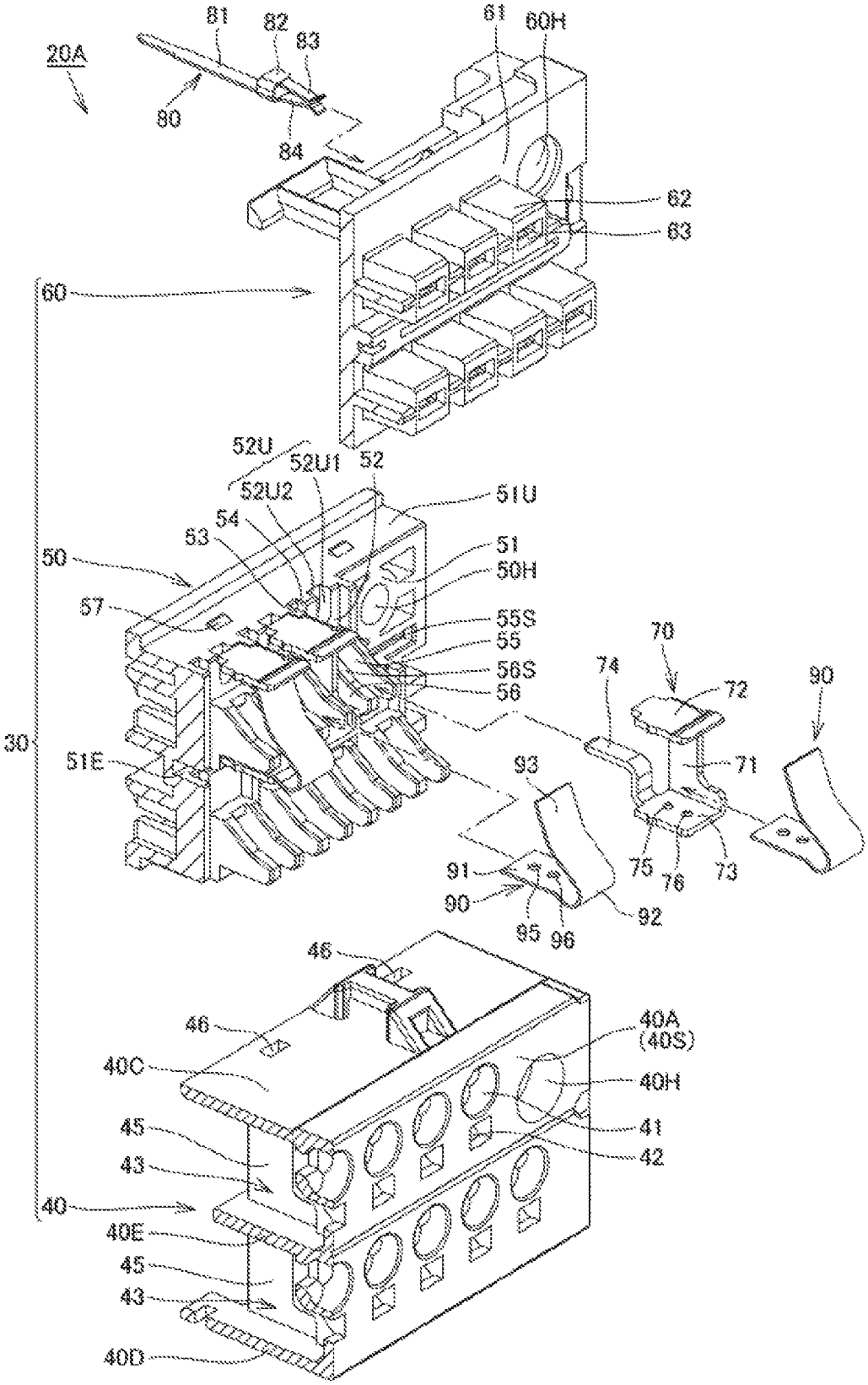
FIG. 4 is a second perspective view (cross-sectional perspective view) showing the exploded terminal block 20A.
Figure 5:
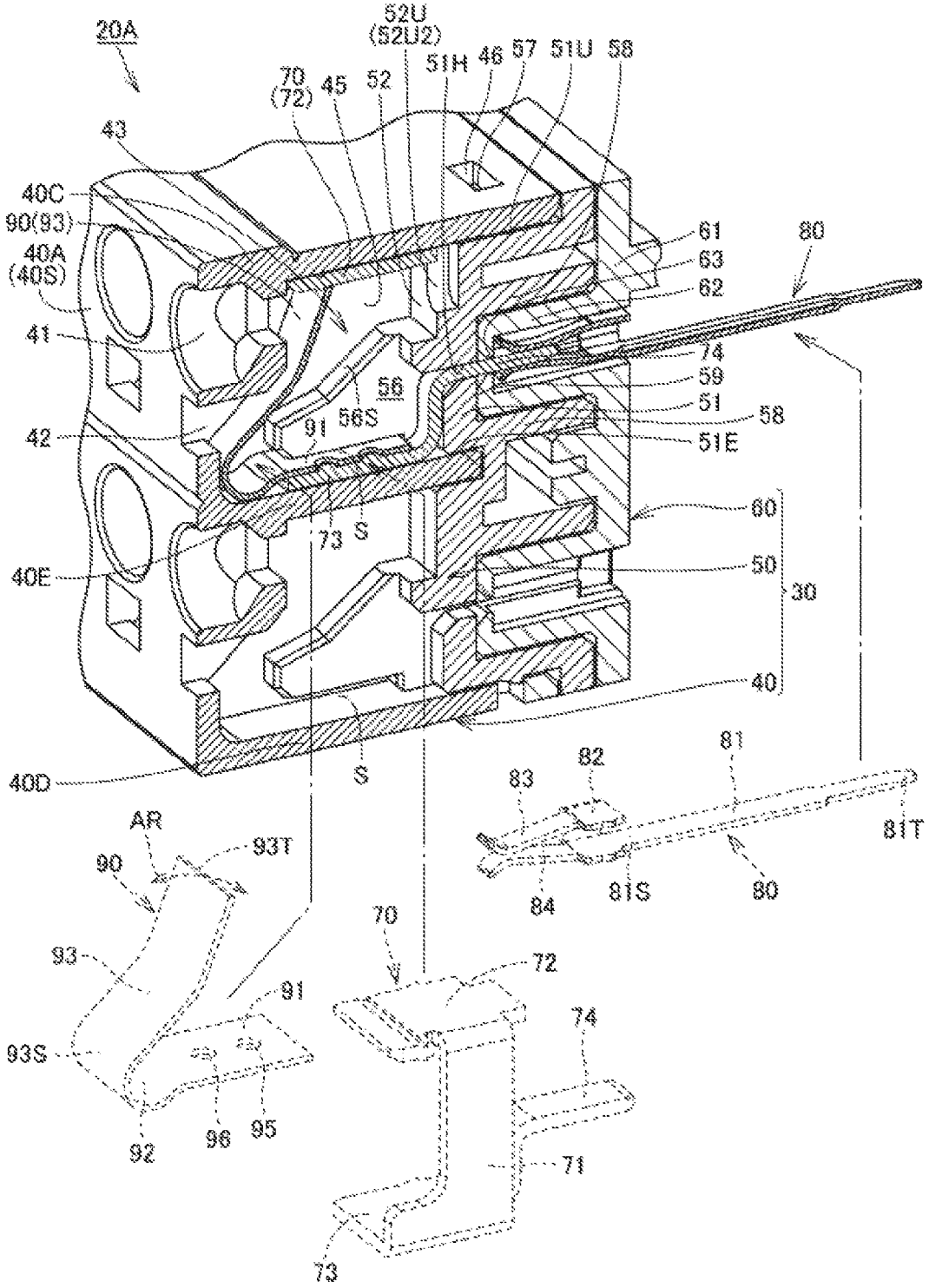
FIG. 5 is a cross-sectional perspective view showing the terminal block 20A.
Figure 6:
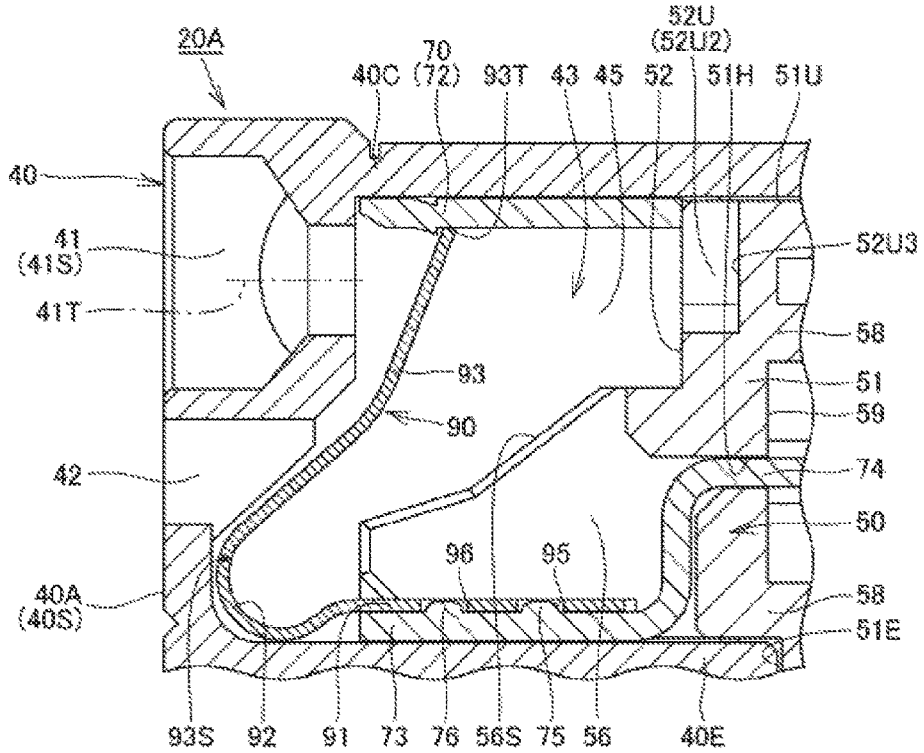
FIG. 6 is a cross-sectional view showing the terminal block 20A.

FIG. 2 is a perspective view showing the terminal block 20A. FIGS. 3 and 4 are perspective views (cross-sectional perspective views) showing the exploded terminal block 20A. FIGS. 5 and 6 are respectively a cross-sectional perspective view and a cross-sectional view showing the exploded terminal block 20A. The terminal block 20A includes a housing 30 (FIGS. 2 to 4), a terminal fitting 70 (FIGS. 3 to 5), an electrode member 80 (FIGS. 3 to 5), and a plate spring 90 (FIGS. 3 to 5). The overall shape of the terminal block 20A is substantially cuboidal (see FIG. 2).

Housing 30

The housing 30 (FIGS. 3 to 5) is constituted by combining a front panel 40, an inner panel 50, and a back panel 60.

Front Panel 40

As shown in FIGS. 3 to 5, the front panel 40 includes a front portion side portions 40B (FIGS. 2 and 3), an upper surface portion 40C, a bottom portion 40D, and a middle portion 40E (FIGS. 4 and 5).

The front portion 40A has a plate shape, and constitutes a front surface 40S of the front panel 40. The front portion 40A is provided with a plurality of through holes 41, a plurality of through holes 42, and a pair of openings 40H (FIGS. 1 and 2) that pass through the front portion 40A. Screws (not shown) for fixing the entire terminal block 20A (FIG. 2) to the main body unit 10 of the control device 100 (FIG. 1) are inserted into the openings 40H and 40H.

As shown in FIGS. 1 and 2, the plurality of through holes 41 are formed side-by-side in two rows along a direction parallel to a longitudinal direction of the terminal block 20A. The plurality of through holes 42 are formed side-by-side in two rows along the direction parallel to the longitudinal direction of the terminal block 20A such that the through holes 41 and the through holes 42 have a one-to-one correspondence relation. One of the through holes 42 is always located directly below one of the through holes 41. The plurality of through holes 41 each have a circular shape, and the plurality of through holes 42 each have a rectangular shape.

The upper surface portion 40C, the bottom portion 40D, and the middle portion 40E of the front panel 40 each have a plate shape (see FIG. 5), and the upper surface portion 40C, the bottom portion 40D, and the middle portion 40E are disposed in parallel to each other. The upper surface portion 40C extends from an upper end of the front portion 40A toward the back, and the bottom portion 40D extends from a lower end of the front portion 40A toward the back. The middle portion 40E extends from a middle position of the front portion 40A toward the back.

A plurality of partition walls 45 (FIGS. 4 and 5) are provided on the back side of the front portion 40A of the front panel 40. The plurality of partition walls 45 are parallel to the side portions 40B (FIG. 3) of the front panel 40. In other words, the plurality of partition walls 45 are disposed orthogonal to the upper surface portion 40C, the bottom portion 40D, and the middle portion 40E.

The plurality of partition walls 45 are disposed in the longitudinal direction of the terminal block 20A at approximately equal intervals, and define spaces formed between the upper surface portion 40C and the middle portion 40E in a plurality of accommodation portions 43, and define spaces formed between the middle portion 40E and the bottom portion 40D in the plurality of accommodation portions 43.

One of the accommodation portions 43 is defined between a pair of adjacent partition walls 45, the front portion 40A, the upper surface portion 40C, the middle portion 40E, and the inner panel 50 (an inner wall portion 52) (FIG. 5). Similarly, another accommodation portion 43 is defined between a pair of adjacent partition walls 45, the front portion 40A, the middle portion 40E, the bottom portion 40D, and the inner panel 50 (an inner wall portion 52) (FIG. 5).

The accommodation portions 43 defined as described above are located inside the housing 30 when viewed from the front portion 40A (see FIG. 2), and one of the through holes 41 and one of the through holes 42 extend from the front portion 40A (front surface 40S) of the front panel 40 to one of the accommodation portions 43 (see FIGS. 4 and 5).

The upper surface portion 40C of the front panel 40 is also provided with a plurality of openings 46 (FIGS. 3 to 5). The openings 46 engage with protrusions 57 (FIGS. 3 to 5) provided on an upper surface 51U of the inner panel 50. When the openings 46 engage with the protrusions 57, the front panel 40 and the inner panel 50 are fixed to each other.

Inner Panel 50

As shown in FIGS. 3 to 5, the inner panel 50 is a member disposed between the front panel 40 and the back panel 60, and includes a base portion 51, inner wall portions 52 (see also FIG. 8), vertical wall portions 53, vertical groove portions 54, ribs 55 and 56, and the protrusions 57.

The base portion 51 extends in a plate shape along the longitudinal direction of the inner panel 50, and openings 50H (FIGS. 3 and 4) are each provided near the two ends in the longitudinal direction of the base portion 51. The openings 40H and 50H are disposed coaxially with each other in a state in which the front panel 40 and the inner panel 50 are fixed to each other, and screws (not shown) for fixing the entire terminal block 20A (FIG. 2) to the main body unit 10 of the control device 100 (FIG. 1) are inserted into the openings 40H and 50H.

As shown in FIG. 6, the inner wall portion 52 of the inner panel 50 is provided at a position that intersects with (herein, is orthogonal to) a direction in which an axis 41T of the through hole 41 extends (an axis direction). That is, the inner wall portion 52 defines one accommodation portion 43 together with a pair of adjacent partition walls 45, the front portion 40A, the upper surface portion 40C, and the middle portion 40E. Similarly, also the other inner wall portions 52 define other accommodation portions 43 together with a pair of adjacent partition walls 45, the front portion 40A, the middle portion 40E, and the bottom portion 40D.

The inner wall portion 52 is provided with, as a portion of a constituent element of the inner wall portion 52, a U-shaped recessed groove 52U in which a side in the upward direction is open and a side in the downward direction is closed. The "downward direction" herein corresponds to a direction in which a plate spring portion 93 of the plate spring 90 undergoes deflection deformation, which will be described later, when the wiring member 11 (see FIG. 7) is inserted into the accommodation portion 43. The "upward direction" herein corresponds to a direction in which a restoring force of elastic deformation of the plate spring portion 93 of the plate spring 90 acts.

Recessed Groove 52U, First Side Wall Portion 52U1, and Second Side Wall Portion 52U2

The U-shaped recessed groove 52U includes a first side wall portion 52U1, a second side wall portion 52U2, and a curved surface portion that connects their lower ends. In other words, the first side wall portion 52U1 and the second side wall portion 52U2 are formed in the recessed groove 52U. Although details will be described later, the plate spring portion 93 of the plate spring 90 and the terminal portion 72 of the terminal fitting 70 are disposed in the accommodation portion 43, and hold the wiring member 11 (FIG. 7) inserted at a position between the terminal portion 72 and the plate spring portion 93.

Figure 7:
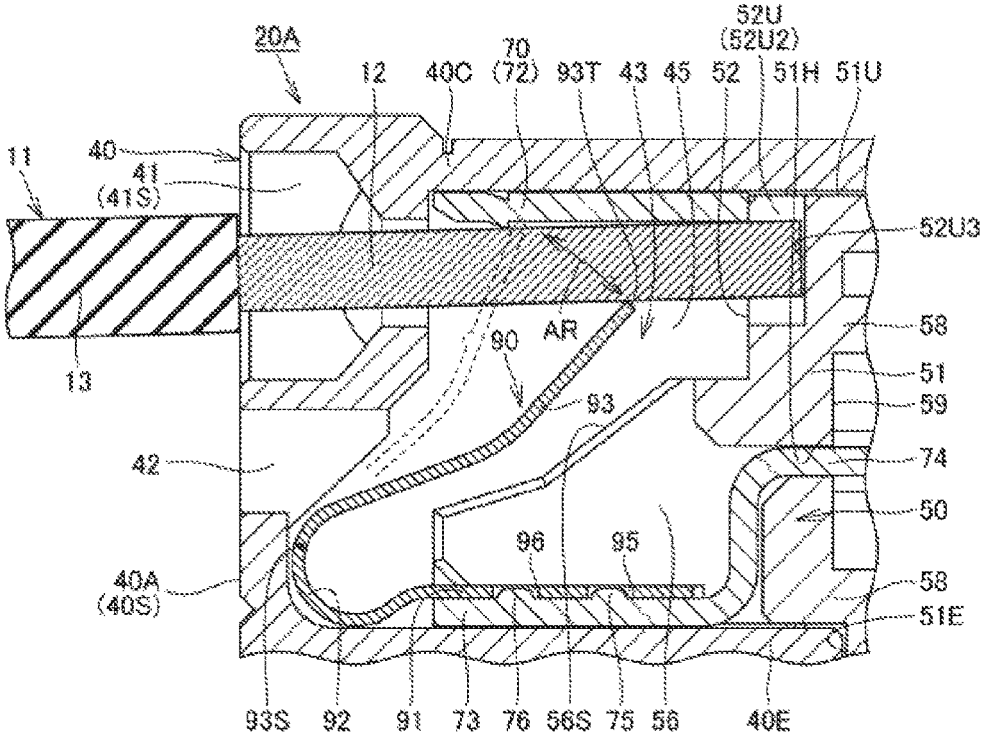
FIG. 7 is a cross-sectional view illustrating operations performed when a wiring member 11 is fixed to the terminal block 20A.

The first side wall portion 52U1 and the second side wall portion 52U2 face each other in a direction that intersects with (herein, the direction perpendicular to the paper plane of FIG. 7) a direction in which the terminal portion 72 and the plate spring portion 93 hold the wiring member 11 (herein, the direction indicated by the arrow AR shown in FIG. 7). In the present embodiment, the first side wall portion 52U1 and the second side wall portion 52U2 are orthogonal to the upper surface portion 40C, the bottom portion 40D, and the middle portion 40E.

Although details will be described later, a movement of a portion (an electrode portion 12) of the wiring member 11 (FIG. 7) that is inserted into the accommodation portion 43 is curbed by disposing the portion (the electrode portion 12) of the wiring member 11 that is inserted into the accommodation portion 43 between the first side wall portion 52U1 and the second side wall portion 52U2. "Movement" here refers to a movement in a direction that intersects with (herein, the direction perpendicular to the paper plane of FIG. 7) a direction in which the terminal portion 72 and the plate spring portion 93 hold the wiring member 11 (herein, the direction indicated by the arrow AR shown in FIG. 7).

The vertical wall portion 53 (FIGS. 3, 4, and 8) has a plate shape, and extends from the base portion 51 toward the front. The vertical wall portion 53 is orthogonal to the upper surface portion 40C, the bottom portion 40D, and the middle portion 40E of the front panel 40. The vertical groove portion 54 is formed between the inner wall portion 52 and the vertical wall portion 53, and provides a recessed space. The partition walls 45 (see FIG. 4) of the front panel 40 are disposed inside the vertical groove portion 54 in a state in which the front panel 40 and the inner panel 50 are fixed to each other.

The ribs 55 and 56 each have a triangular prismatic shape, and extend from positions of the inner wall portion 52 toward the front. The ribs 55 and 56 are spaced apart from each other at intervals in the longitudinal direction of the base portion 51. Upper surfaces 55S and 56S of the ribs 55 and 56 have an inclined surface shape, and the ribs 55 and 56 are inclined such that upper portions of the upper surfaces 55S and 56S are located on the back side, and lower portions of the upper surfaces 55S and 56S are located on the front side.

Openings 51H are provided at positions of the base portion 51 located between the ribs 55 and 56 while passing through the base portion 51. Although details will be described later, an L-shaped portion 74 of the terminal fitting 70 is inserted into the opening 51H (see FIGS. 5 and 6). The upper surface 51U of the base portion 51 is also provided with a plurality of protrusions 57 (FIGS. 3 to 5). When the openings 46 provided in the upper surface portion 40C of the front panel 40 engage with the protrusions 57 provided in the base portion 51 (the upper surface 51U) of the inner panel 50, the front panel 40 and the inner panel 50 are fixed to each other.

As shown in FIG. 5, a recessed portion 51E is provided on the front side of the base portion 51 (see also FIG. 4). The recessed portion 51E extends in the form of a groove along the longitudinal direction of the base portion 51. The recessed portion 51E has a shape corresponding to the front end portion of the middle portion 40E of the front panel 40, and the middle portion 40E of the front panel 40 is disposed inside the recessed portions 51E in a state in which the front panel 40 and the inner panel 50 are fixed to each other (see FIG. 5).

As shown in FIG. 5, a plurality of plate-shaped portions 58 are provided on the back side of the base portion 51, and a recess 59 is formed between adjacent plate-shaped portions 58 and 58. The back panel 60 is provided with protruding portions 62 (FIGS. 3 and 4), and the protruding portions 62 are disposed inside the recesses 59 in a state in which the inner panel 50 and the back panel 60 are fixed to each other (see FIG. 5).

Back Panel 60

As shown in FIGS. 3 to 5, the back panel 60 is a member that is disposed on the back side of the inner panel 50, and includes a base portion 61, the protruding portions 62, and openings 63.

The base portion 61 extends in a plate shape along the longitudinal direction of the back panel 60, and openings 60H (see FIGS. 3 and 4) are provided near the two ends in the longitudinal direction of the base portion 61. The openings 40H, 50H, and 60H are disposed coaxially with each other in a state in which the front panel 40, the inner panel 50, and the back panel 60 are fixed to each other, and screws (not shown) for fixing the entire terminal block 20A (FIG. 2) to the main body unit 10 of the control device 100 (FIG. 1) are inserted into the openings 40H, 50H, and 60H.

The protruding portions 62 have a substantially cuboidal shape, and extend from the base portion 61 toward the front. The protruding portions 62 have a hollow shape, and a front end portion of the electrode member 80, which will be described later, is disposed inside one of the protruding portions 62 (see FIG. 5). The openings 63 pass through sites of the protruding portions 62 on the front side. Although details will be described later, an L-shaped portion 74 of the terminal fitting 70 is inserted into the opening 63 (see FIG. 5).

Terminal Fitting 70

As shown in FIGS. 3 to 5, the terminal fitting 70 includes a rising wall portion 71, a terminal portion 72, a base portion 73, and the L-shaped portion 74. The terminal fitting 70 is disposed in the accommodation portion 43 together with the plate spring 90, which will be described later.

The rising wall portion 71, the terminal portion 72, and the base portion 73 each have a substantially flat-plate shape. The terminal portion 72 extends from the upper end of the rising wall portion 71 in a direction that is substantially orthogonal to the rising wall portion 71, and the base portion 73 extends from the lower end of the rising wall portion 71 in a direction that is substantially orthogonal to the rising wall portion 71. The overall shape of the rising wall portion 71, the terminal portion 72, and the base portion 73 resembles a C-shape, and the L-shaped portion 74 extends from the base portion 73 toward the back.

The surface of the base portion 73 is provided with protrusions 75 and 76. Although details will be described later, a base portion 91 of the plate spring 90 is provided with openings 95 and 96 corresponding to the protrusions 75 and 76. When the base portion 91 of the plate spring 90 is placed on the base portion 73 of the terminal fitting 70, the protrusions 75 and 76 are respectively disposed in the openings 95 and 96 (see FIG. 6), and thus the position of the plate spring 90 with respect to the terminal fitting 70 is determined (defined).

The L-shaped portion 74 is connected to a portion of the back side of the base portion 73, extends upward from the portion of the back side of the base portion 73, linearly extends from a front end portion of this extension portion toward the back side, and the overall shape of the L-shaped portion 74 is substantially L-shaped. As described above, the opening 51H is provided at a position located between the ribs 55 and 56 provided on the inner panel 50 while passing through the base portion 51. Furthermore, the protruding portions 62 of the back panel 60 are provided with the openings 63. The L-shaped portion 74 of the terminal fitting 70 is inserted into the openings 51H and 63 (see FIG. 5).

Electrode Member 80

As shown in FIGS. 3 to 5, the electrode member 80 includes a flat-plate portion 81, a U-shaped portion 82, and a pair of holding pieces 83 and 84, and its overall shape is substantially a rod shape.

The flat-plate portion 81 extends linearly, and one end 81T (FIG. 5) of the flat-plate portion 81 is electrically connected to a control board disposed in the main body unit 10 of the control device 100 (FIG. 1). The U-shaped portion 82 is provided at the other end 81S of the flat-plate portion 81. The pair of holding pieces 83 and 84 are provided opposite the flat-plate portion 81 with respect to the U-shaped portion 82.

As described above, the back panel 60 is provided with the protruding portions 62. The U-shaped portion 82 and the holding pieces 83 and 84 of the electrode member 80 are disposed inside the protruding portion 62 (see FIG. 5). The L-shaped portion 74 of the terminal fitting 70 is inserted in the openings 51H and 63, and when the holding pieces 83 and 84 of the electrode member 80 hold the L-shaped portion 74 of the terminal fitting 70, the terminal fitting 70 and the electrode member 80 are electrically connected to each other.

Referring to FIGS. 5 and 6, as described above, the accommodation portions 43 are defined between the front panel 40 and the inner panel 50 (between the upper surface portion 40C and the middle portion 40E) in a state in which the front panel 40 is fixed to the inner panel 50. In this state, a gap S is formed between the lower surface of the rib 56 (and the lower surface of the rib 55 (not shown)) and the upper surface of the middle portion 40E (see FIG. 5).

In a state in which the members are assembled together as the terminal block 20A (in the state of the completed terminal block 20A), the base portion 73 of the terminal fitting 70 is disposed inside the gap S. Furthermore, the terminal portion 72 of the terminal fitting 70 faces the lower surface of the upper surface portion 40C (see FIGS. 5 and 6). The same applies to the accommodation portions 43 defined between the middle portion 40E and the bottom portion 40D and the terminal fittings 70 disposed in these accommodation portions 43.

Plate Spring 90

As shown in FIGS. 3 to 5, the plate spring 90 includes the base portion 91, a curved portion 92, and a plate spring portion 93. The plate spring 90 is disposed in the accommodation portion 43 together with the terminal fitting 70.

The base portion 91 and the plate spring portion 93 each have a substantially flat-plate shape, and the curved portion 92 is provided between the base portion 91 and the plate spring portion 93. As described above, the base portion 91 of the plate spring 90 is provided with the openings 95 and 96 corresponding to the protrusions 75 and 76 of the terminal fitting 70. When the base portion 91 of the plate spring 90 is placed on the base portion 73 of the terminal fitting 70, the protrusions 75 and 76 are respectively disposed in the openings 95 and 96 (see FIG. 6), and thus the position of the plate spring 90 with respect to the terminal fitting 70 is determined (defined).

The accommodation portions 43 are defined between the front panel 40 and the inner panel 50 (between the upper surface portion 40C and the middle portion 40E) in a state in which the front panel 40 is fixed to the inner panel 50. In this state, a gap S is formed between the lower surface of the rib 56 (and the lower surface of the rib 55 (not shown)) and the upper surface of the middle portion 40E (see FIG. 5). The base portion 91 of the plate spring 90 is disposed inside the gap S together with the base portion 73 of the terminal fitting 70.

The curved portion 92 is substantially C-shaped in a cross-sectional view, and is connected to an end of the base portion 91 on the front side. The plate spring portion 93 is connected to the upper end of the curved portion 92. The plate spring portion 93 is inclined such that the upper portion of the plate spring portion 93 is located on the back side, and the lower portion of the plate spring portion 93 is located on the front side. One end of the plate spring portion 93 is supported by the curved portion 92, and the plate spring portion 93 can undergo deflection deformation like a plate spring.

For example, when the plate spring portion 93 is pressed by the wiring member 11 (see the wiring member 11 in FIG. 7) inserted into the accommodation portion 43 through the through hole 41, the plate spring portion 93 undergoes deflection deformation. Alternatively, when the plate spring portion 93 is pressed by a tool (a flathead screwdriver or the like) inserted into the accommodation portion 43 through the through hole 42, the plate spring portion 93 undergoes deflection deformation.

The plate spring portion 93 includes a base portion 93S (FIG. 6) that forms a fixed end of deflection deformation, and a front end portion 93T (FIG. 6) that forms a free-end of deflection deformation. The plate spring portion 93 is disposed in the accommodation portion 43 such that the front end portion 93T is located closer to the through hole 41 than the base portion 93S, and the base portion 93S is located closer to the through hole 42 than the front end portion 93T.

The plate spring portion 93 is spaced apart from and faces the upper surface 55S and 56S of the ribs 55 and 56 in a state in which the plate spring 90 is disposed in the accommodation portion 43 (see FIG. 6). The ribs 55 and 56 (upper surfaces 55S and 56S) provided in the accommodation portion 43 can curb an amount of deflection deformation (the maximum deflection deformation amount) of the plate spring portion 93 of the plate spring 90.

The front end portion 93T of the plate spring portion 93 faces the terminal portion 72 of the terminal fitting 70, and is capable of holding, together with the terminal portion 72, the wiring member (see the wiring member 11 in FIG. 7) inserted into the accommodation portion 43 through the through hole 41 (see FIG. 7). In the present embodiment, the front end portion 93T of the plate spring portion 93 is in contact with the terminal portion 72 of the terminal fitting 70 in a state in which the wiring member 11 (FIG. 7) is not inserted into the through hole 41 and the tool 14 (FIG. 8) is not inserted in the through hole 42, that is, in the natural state of the plate spring 90 (see FIG. 6).

In the present embodiment, a member (the terminal fitting 70) that constitutes the terminal portion 72 and a member (the plate spring 90) that constitutes the plate spring portion 93 are constituted by separate members, and are disposed in the accommodation portion 43 in a state in which these members are assembled with each other. The present invention is not limited to such a configuration, and the member that constitutes the terminal portion 72 and the member that constitutes the plate spring portion 93 may also be constituted by a single member.

Effects

Figure 8:
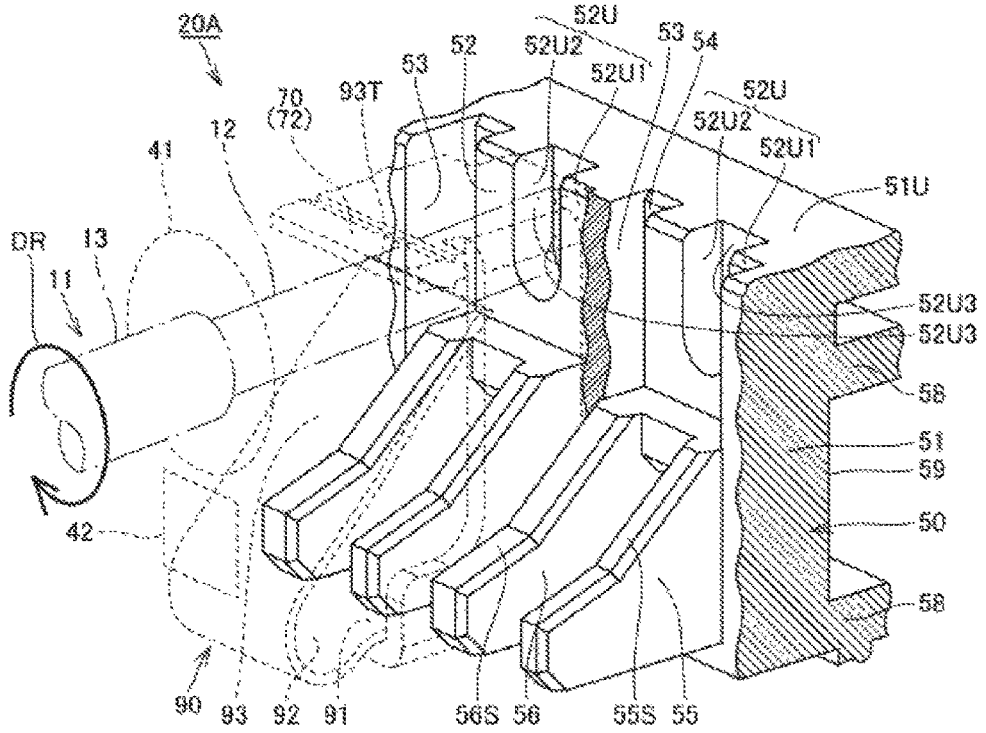
FIG. 8 is a perspective view showing a situation when a force acts on the wiring member 11 fixed to the terminal block 20A in a direction in which the wiring member 11 is twisted.

Referring to FIGS. 7 and 8, when the wiring member 11 such as a single wire or a rod terminal is fixed to the terminal block 20A, the wiring member 11 passes through the through hole 41, and is inserted at a position between the plate spring portion 93 of the plate spring 90 and the terminal portion 72 of the terminal fitting 70. The wiring member 11 is inserted until coining into contact with the inner wall portion 52 (specifically, an inner surface 52U3 in the recessed groove 52U) while subjecting the plate spring portion 93 to deflection deformation as shown in FIGS. 7 and 8.

The wiring member 11 has an electrode portion 12 and a covered portion 13, and when the electrode portion 12 is held between the plate spring portion 93 of the plate spring 90 and the terminal portion 72 of the terminal fitting 70, the wiring member 11 is fixed. The wiring member 11 is pressed against the terminal portion 72 of the terminal fitting 70 by an elastic restoring force of the plate spring 90 (the plate spring portion 93), and thus the wiring member 11 is electrically connected to the terminal fitting 70.

When the wiring member 11 is removed, the wiring member 11 can be pulled out by subjecting the plate spring portion 93 that presses the wiring member 11 against the terminal portion 72 to undergo deflection deformation in a direction away from the wiring member 11 (the terminal portion 72). It is possible to easily dispose the wiring member 11 at the position located between the plate spring portion 93 and the terminal portion 72 by subjecting the plate spring portion 93 to undergo deflection deformation in a direction away from the terminal portion 72 not only in the case where the wiring member 11 is pulled out but also in the case where the wiring member 11 with low rigidity is inserted toward the terminal portion 72. By inserting a tool (for example, a flathead screwdriver or the like) into the accommodation portion 43 through the through hole 42 as a specific means, the plate spring portion 93 can be subjected to deflection deformation easily in a direction away from the terminal portion 72.

In the present embodiment, the plate spring portion 93 of the plate spring 90 and the terminal portion 72 of the terminal fitting 70 hold the wiring member 11 (FIG. 7) inserted at a position between the terminal portion 72 and the plate spring portion 93. The first side wall portion 52U1 and the second side wall portion 52U2 face each other in a direction that intersects with (herein, the direction perpendicular to the paper plane of FIG. 7) a direction in which the terminal portion 72 and the plate spring portion 93 hold the wiring member 11 (herein, the direction indicated by the arrow AR shown in FIG. 7).

A movement of a portion (the electrode portion 12) of the wiring member 11 (FIG. 7) that is inserted into the accommodation portion 43 is curbed by disposing the portion (the electrode portion 12) of the wiring member 11 that is inserted into the accommodation portion 43 between the first side wall portion 52U1 and the second side wall portion 52U2. "Movement." here refers to a movement in a direction that, intersects with (herein, the direction perpendicular to the paper plane of FIG. 7) a direction in which the terminal portion 72 and the plate spring portion 93 hold the wiring member 11 (herein, the direction indicated by the arrow AR shown in FIG. 7).

Thus, in the terminal block 20A in the present embodiment, in a state in which the wiring member 11 is inserted between the plate spring portion 93 and the terminal portion 72, a movement in a direction that intersects with (herein, a direction orthogonal to) a direction in which the plate spring portion 93 and the terminal portion 72 hold the wiring member 11 is curbed by the first side wall portion 52U1 and the second side wall portion 52U2 while the wiring member 11 is subjected to holding forces from the plate spring portion 93 and the terminal portion 72.

Even if a twisting force (see arrow DR in FIG. 8) repeatedly acts on the wiring member 11, the wiring member 11 hardly moves in a direction in which the plate spring portion 93 and the terminal portion 72 hold the wiring member 11, and the wiring member 11 hardly moves in a direction that intersects with (herein, a direction orthogonal to) the direction in which the plate spring portion 93 and the terminal portion 72 hold the wiring member 11.

Thus, the possibility that the wiring member 11 will come off from a position between the plate spring portion 93 and the terminal portion 72 is effectively reduced, compared to the case where neither the first side wall portion 52U1 nor the second side wall portion 52U2 are provided in the accommodation portion 43. The terminal block 20A having such a configuration is capable of exhibiting high reliability as a means for connecting the control device 100 (FIG. 1) and another device via the wiring member 11.

First Modification

Figure 9:
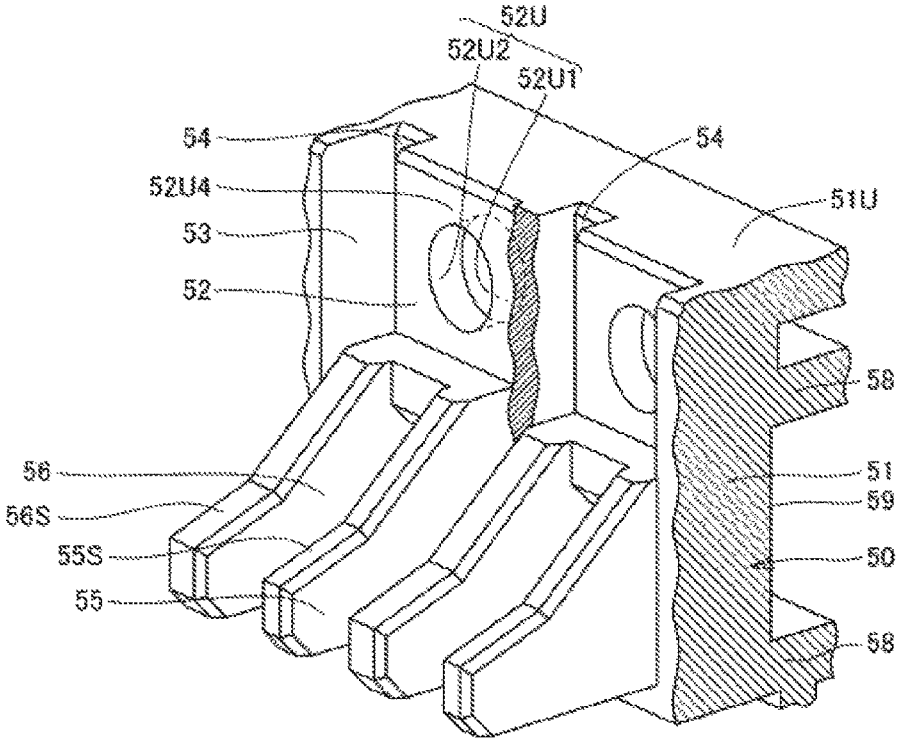
FIG. 9 is a perspective view showing an inner panel 50 applied to a terminal block in a first modification of an embodiment.

FIG. 9 is a perspective view showing an inner panel 50 applied to a terminal block in a first modification of an embodiment.

In the above-described embodiment, the accommodation portion 43 is provided with the inner wall portion 52 that intersects with a direction in which the axis 41T of the through hole 41 extends (the axis direction), the inner wall portion 52 is provided with the U-shaped recessed groove 52U in which a side in the upward direction is open and a side in the downward direction is closed, and the first side wall portion 52U1 and the second side wall portion 52U2 are formed in the U-shaped recessed groove 52U.

As shown in FIG. 9, the first side wall portion 52U1 and the second side wall portion 52U2 may also be formed in a recessed groove 52U having a circular shape in a front view. With this configuration, it is also possible to obtain effects that are substantially similar to those of the above-described embodiment.

Note that the recessed groove 52U has a U-shape in the above-described embodiment. A portion (a portion 52U4 shown in FIG. 9) outward of a portion of the inner wall portion 52 (the recessed groove 52U) in which the front end portion of the wiring member 11 is disposed is a space in the embodiment (see FIG. 8), and is open. When the wiring member 11 is inserted between the plate spring portion 93 and the terminal portion 72, the wiring member 11 is subjected to a force caused by an elastic restoring force of the plate spring portion 93, and easily comes into contact with the portion 52U4 shown in FIG. 9. Because the portion outward of the portion in which the front end portion of the wiring member 11 is disposed is open in the above-described embodiment, the above-described embodiment has an advantage in that an operator can easily dispose the wiring member 11 in the recessed groove 52U and easily perform a wiring operation.

Second Modification

Figure 10:
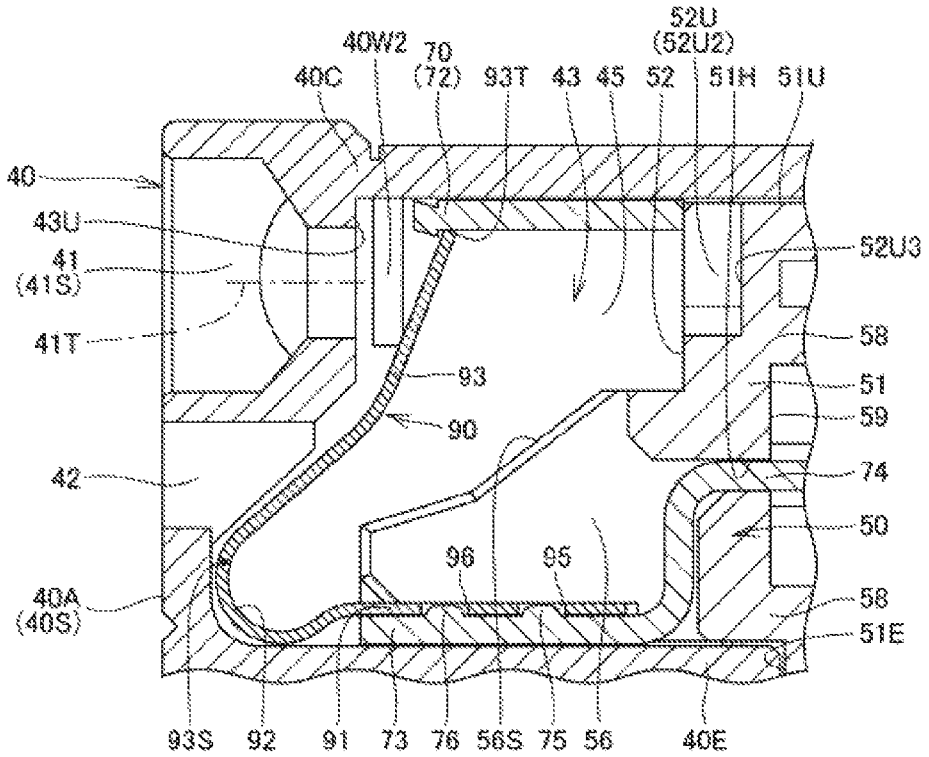
FIG. 10 is a cross-sectional view showing an inner panel 50 and the like applied to a terminal block in a second modification of an embodiment.
Figure 11:
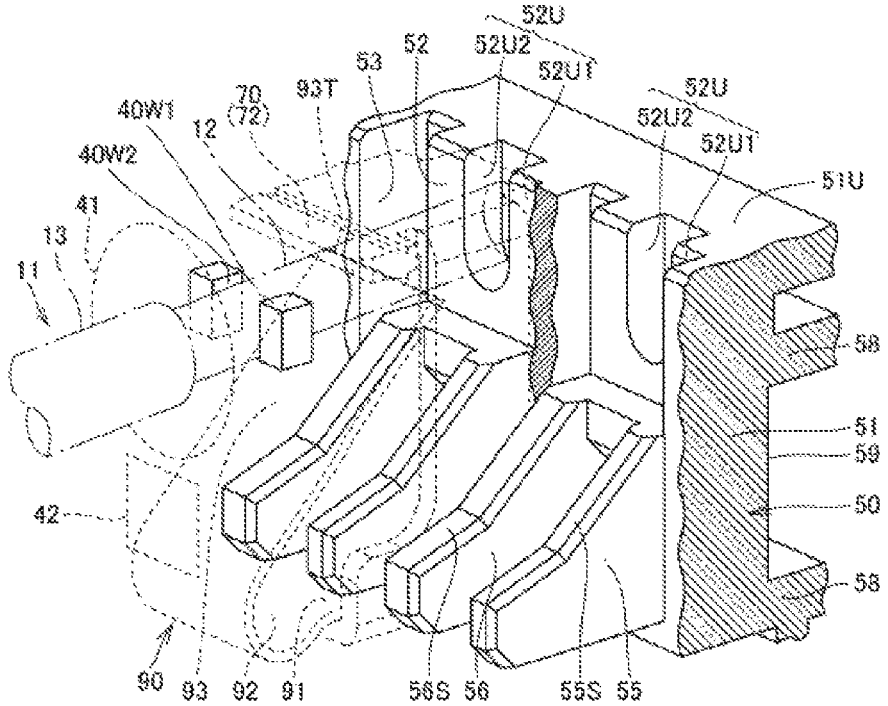
FIG. 11 is a perspective view showing an inner panel 50 and the like applied to a terminal block in a second modification of an embodiment.

FIGS. 10 and 11 are respectively a cross-sectional view and a perspective view showing an inner panel 50 and the like applied to a terminal block in a second modification of an embodiment.

In the above-described embodiment, the plate spring portion 93 includes a base portion 93S that constitutes a fixed end of deflection deformation and a front end portion 93T that constitutes a free-end of deflection deformation when the plate spring portion 93 is pressed by the wiring member 11 inserted into the accommodation portion 43 through the through hole 41, and the first side wall portion 52U1 and the second side wall portion 52U2 are located opposite the through hole 41 with respect to the front end portion 93T of the plate spring portion 93 in a state in which the wiring member 11 is not inserted into the through hole 41 (see FIG. 6). In other words, the front end portion 93T of the plate spring portion 93 is located between the through hole 41, and the first side wall portion 52U1 and the second side wall portion 52U2 in a state in which the wiring member 11 is not inserted into the through hole 41.

As shown in FIGS. 10 and 11, in the present modification, a lower surface of an upper surface portion 40C is provided with a first side wall portion 40W1 (FIG. 11) and a second side wall portion 40W2 that extend downward. The first side wall portion 40W1 (FIG. 11) and the second side wall portion 40W2 are positioned on the side of a through hole 41 with respect to a front end portion 93T of a plate spring portion 93. In other words, the first side wall portion 40W1 (FIG. 11) and the second side wall portion 40W2 are located in an accommodation portion 43, and are located between an inner surface 43U (FIG. 10) that defines the accommodation portion 43 and the front end portion 93T of the plate spring portion 93 in a front portion 40A of a front panel 40.

As a result of a portion (an electrode portion 12) of a wiring member 11 (FIG. 11) that is inserted into the accommodation portion 43 being disposed between the first side wall portion 40W1 and the second side wall portion 40W2, a movement of the portion (the electrode portion 12) of the wiring member 11 that is inserted into the accommodation portion 43 is curbed. "Movement" here refers to a movement in a direction that intersects with (the direction perpendicular to the paper plane of FIG. 11) a direction in which a terminal portion 72 and the plate spring portion 93 hold the wiring member 11.

Even if a twisting force (see the arrow DR in FIG. 8) repeatedly acts on the wiring member 11, the wiring member 11 hardly moves in the direction in which the plate spring portion 93 and the terminal portion 72 hold the wiring member 11, and the wiring member 11 hardly moves, due to the first side wall portion 40W1 and the second side wall portion 40W2, in a direction that intersects with (herein, a direction orthogonal to) the direction in which the plate spring portion 93 and the terminal portion 72 hold the wiring member 11.

Although in addition to the first side wall portion 52U1 and the second side wall portion 52U2, the first side wall portion 40W1 and the second side wall portion 40W2 are provided in the accommodation portion 43 in FIGS. 10 and 11, only the first side wall portion 40W1 and the second side wall portion 40W2 may also be provided in the accommodation portion 43. In this case, it is also possible to obtain effects that are similar to those of the above-described embodiment.

Although an embodiment was described above, the content disclosed above is to be considered exemplary in all respects and in no way limiting. The technical scope of the present invention is indicated by the scope of the claims, and all changes that come within the meaning and range of equivalency of the claims are intended to be embraced therein.

INDEX TO THE REFERENCE NUMERALS

10 Main body unit
10P Display panel
11 Wiring member
12 Electrode portion
13 Covered portion
14 Tool
20A, 20B Terminal block
30 Housing
40 Front panel
40A Front portion
40B Side portion
40C Upper surface portion
40D Bottom portion
40E Middle portion
40H, 46, 50H, 51H, 60H, 63, 95, 96 Opening
40S Front surface
40W1, 52U1 First side wall portion
40W2, 52U2 Second side wall portion
41, 42 Through hole
41T Axis
43 Accommodation portion
43U, 52U3 Inner surface
45 Partition wall
50 Inner panel
51, 61 Base portion
51E Recessed portion
51U, 55S, 56S Upper surface
52 Inner wall portion
52U Recessed groove
52U4 Portion
53 Vertical wall portion
54 Vertical groove portion
55, 56 Rib
57, 75, 76 Protrusion
58 Plate-shaped portion
59 Recess
60 Back panel
62 Protruding portion
70 Terminal fitting
71 Rising wall portion
72 Terminal portion
73 Base portion
74 L-shaped portion
80 Electrode member
81 Flat-plate portion
81S Another end
81T One end
82 U-shaped portion
83, 84 Holding piece
90 Plate spring
91 Base portion
92 Curved portion
93 Plate spring portion
93S Base portion
93T Front end portion
100 Control device
DR Arrow
S Gap

The invention claimed is:

1. A terminal block comprising:

a housing including a front portion, an accommodation portion located on an inner side when viewed from the front portion, and a through hole that extends from the front portion to the accommodation portion;

a terminal portion disposed in the accommodation portion of the housing; and a plate spring portion that is disposed in the accommodation portion of the housing and, together with the terminal portion, holds a wiring member inserted into the accommodation portion through the through hole, wherein a first side wall portion and a second side wall portion are formed in the accommodation portion of the housing, the first side wall portion and the second side wall portion facing each other in a direction that intersects with a direction in which the plate spring portion and the terminal portion hold the wiring member, a movement, in the intersecting direction, of a portion of the wiring member that is inserted into the accommodation portion is curbed by disposing the portion of the wiring member that is inserted into the accommodation portion between the first side wall portion and the second side wall portion, the accommodation portion is formed by combining together a front panel forming the front portion, and an inner panel disposed on the inner side when viewed from the front panel, the plate spring portion includes a base portion that constitutes a fixed end of deflection deformation and a front end portion that constitutes a free-end of deflection deformation when the plate spring portion is pressed by the wiring member inserted into the accommodation portion through the through hole, the first side wall portion and the second side wall portion are located opposite the through hole with respect to the front end portion of the plate spring portion in a state in which the wiring member is not inserted into the through hole, and if a direction in which the plate spring portion undergoes deflection deformation when the wiring member is inserted into the accommodation portion is regarded as a downward direction, and a direction in which a restoring force of elastic deformation of the plate spring portion acts is regarded as an upward direction, the accommodation portion is provided with an inner wall portion that intersects with an axis of the through hole, the inner wall portion is provided with a U-shaped recessed groove in which a side in the upward direction is open and a side in the downward direction is closed, and the first side wall portion and the second side wall portion are formed in the recessed groove.

* * * * *